United States Patent [19]

Kahl et al.

[11] 4,305,736

[45] Dec. 15, 1981

[54] CLEANING OF HIGH-VOLTAGE ELECTRODES IN AN ELECTROSTATIC PRECIPITATOR

[75] Inventors: Melvin R. Kahl, Richland, Pa.; Peter C. Gelfand, San Jose, Calif.

[73] Assignee: General Electric Co., Arlington, Va.

[21] Appl. No.: 144,713

[22] Filed: Apr. 28, 1980

[51] Int. Cl.[3] ..... B03C 3/76

[52] U.S. Cl. ..... 55/112; 335/262; 335/255; 55/146; 173/117

[58] Field of Search ..... 55/12, 13, 112, 101, 55/146; 335/262, 255; 173/167, 117; 174/152 R; 310/30, 34, 35

[56] References Cited

U.S. PATENT DOCUMENTS

| | | | |
|---|---|---|---|
| 3,348,178 | 10/1967 | Erickson et al. | 335/262 |
| 3,504,480 | 4/1970 | Copcutt et al. | 55/112 |
| 4,008,057 | 2/1977 | Gelfand et al. . | |
| 4,093,431 | 6/1978 | Frauenfelder | 55/146 |
| 4,120,672 | 10/1978 | Lanese . | |

FOREIGN PATENT DOCUMENTS

| | | | |
|---|---|---|---|
| 52-22179 | 2/1977 | Japan | 55/112 |
| 747179 | 3/1956 | United Kingdom | 55/112 |

OTHER PUBLICATIONS

Buell Impact Rapper Envirotech Service & Parts, copyright 1978, pp. 1,2, Lebanon, Pa.

Buell Precipitator Rapping System, pp. 1,2, copyright 1977, Lebanon, Pa.

*Primary Examiner*—Bernard Nozick

*Attorney, Agent, or Firm*—Philip L. Schlamp; Joseph B. Forman; Fred Jacob

[57] ABSTRACT

An impact device (15) applies hammer-like blows, or impact forces, to a metallic support frame (13) from which high-voltage electrodes (10) are suspended in an electrostatic precipitator in order to dislodge accumulated particulates from high-voltage electrodes (10). The impact device (15) is electrically isolated by an insulator (19) from metallic components of the precipitator other than the support frame (13) and components electrically connected to the support frame (13). The insulator (19) has a bore (18) that accommodates movement of the impact device (15) from a withdrawn position away from the support frame (13) to an impact position in contact with the support frame (13) upon energization and de-energization of a solenoid (17). The insulator (19) remains unstressed as the impact device (15) contacts the support frame (13).

4 Claims, 1 Drawing Figure

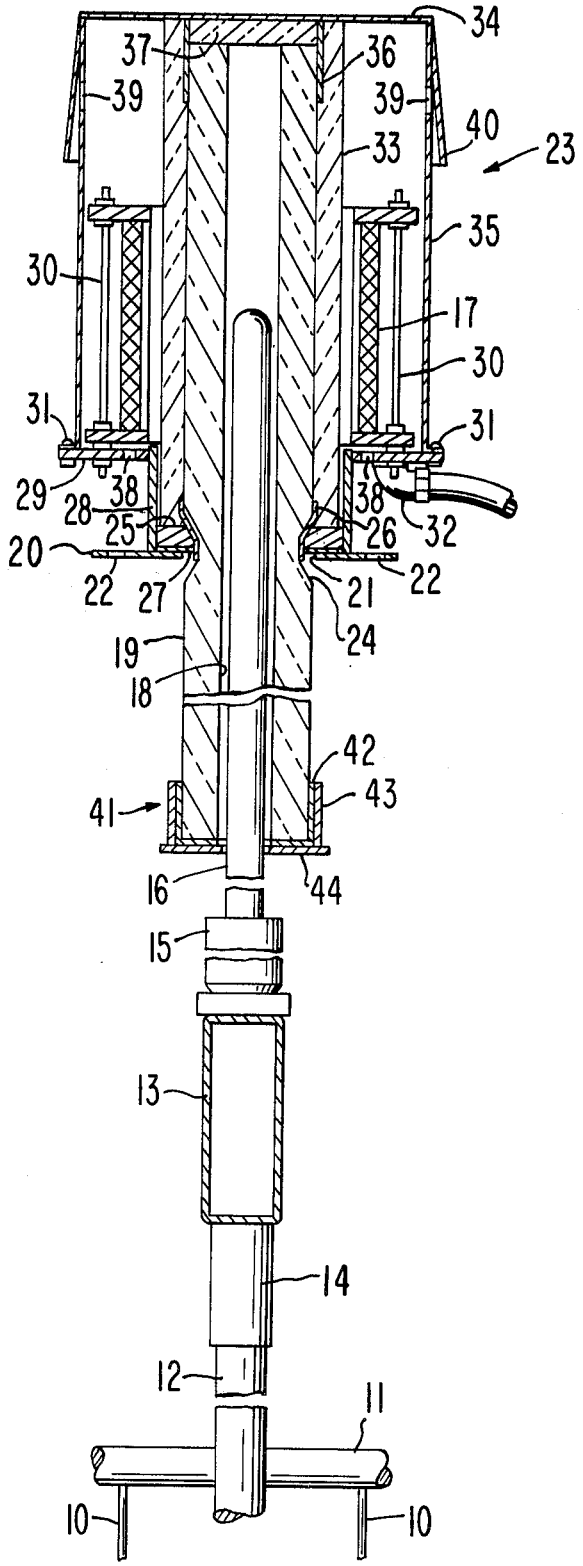
34
37
36
39
39
40
23
33
35
30
17
30
31
31
29
38
38
28
25
26
32
20
22
27
21
22
24
19
18
42
43
41
16
44
15
13
14
12
11
10
10

CLEANING OF HIGH-VOLTAGE ELECTRODES IN AN ELECTROSTATIC PRECIPITATOR

BACKGROUND OF THE INVENTION

1. Field of the Invention

This invention pertains to apparatus for cleaning high-voltage electrodes in an electrostatic precipitator by applying impact forces to an electrically charged support frame from which the electrodes are suspended.

2. State of the Prior Art

In an electrostatic precipitator, corona-generating electrodes are typically suspended from a metallic frame that serves as a mechanical support structure for the electrodes and also as an electrical conductor for supplying high-voltage power to the electrodes. A very effective technique for dislodging particulates that have accumulated on the high-voltage electrodes of an electrostatic precipitator is to apply hammer-like impact forces to the support frame from which the electrodes are suspended. Solenoid-actuated impact devices called "impact rappers" have been used for applying impact forces to electrode support frames in electrostatic precipitators.

When impact rappers were used in the prior art to rap (i.e., to apply impact forces to) a support frame for the high-voltage electrodes of an electrostatic precipitator, the impact rappers were electrically isolated from the support frame to prevent grounding of the high-voltage electrodes. Electrical isolation of the impact rappers was provided by insulators attached to the support frame or to the impact rappers, and the impact forces were transmitted to the support frame through the insulators.

Positioning of the insulators between the impact rappers and the support frame in the prior art resulted in attenuation of the impact forces applied to the support frame, thereby reducing the effectiveness of the impact forces in cleaning the high-voltage electrodes. Furthermore, the insulators used in the prior art to prevent grounding of the high-voltage electrodes of an electrostatic precipitator were subjected to severe mechanical stresses during the rapping procedure to clean the electrodes. Often, the insulators developed fractures after repeated stressing due to the impact forces.

OBJECT OF THE INVENTION

It is an object of the present invention to provide a mounting assembly for a solenoid-actuated impact rapper used in an electrostatic precipitator to dislodge particulates from high-voltage electrodes by applying impact forces to a metallic support frame to which the electrodes are electrically connected, where the impact rapper is electrically isolated from metallic components of the precipitator other than the support frame and components electrically connected to the support frame.

It is also an object of the present invention to provide an insulator for preventing electrical contact between an impact rapper and other metallic components of an electrostatic precipitator, except between the impact rapper and a support frame to which high-voltage electrodes are electrically connected, where the insulator is not subjected to mechanical stress when the impact rapper applies hammer-like impact forces to the support frame in order to clean the electrodes.

It is a further object of the present invention to provide a mounting assembly for a solenoid-actuated impact rapper used to dislodge particulates from high-voltage electrodes suspended from a support frame in an electrostatic precipitator, where the mounting assembly comprises an insulator that electrically isolates the impact rapper from metallic components of the precipitator other than the support frame and components electrically connected to the support frame, where the insulator remains unstressed during the application of impact forces to the support frame, and where a guide means attached to the insulator prevents the impact rapper from wearing against the insulator as the impact rapper moves toward or away from the support frame.

DESCRIPTION OF THE DRAWING

The drawing consists of a single FIGURE, which is a broken cross-sectional view of a mounting assembly for an impact rapper according to the present invention.

DESCRIPTION OF PREFERRED EMBODIMENT

With reference to the drawing, an array of vertically suspended high-voltage electrodes 10, each of which is attached to a horizontally extending high-voltage conductor 11, is housed within an electrostatic precipitator. In a typical precipitator, there would be a plurality of such horizontal electrical conductors 11 arranged in parallel rows, with each conductor 11 having a plurality of spaced-apart high-voltage electrodes 10 suspended therefrom.

As indicated in the drawing, each conductor 11 is affixed by conventional means, as by bolting or welding, to a vertical support rod 12. Alternatively, the conductors 11 and the support rod 12 might form an integral structure, with the electrodes 10 being attached thereto. Each support rod 12 is affixed to a horizontal support frame 13, as by being screw-threaded into a collar member 14 that is integral with or attached to the support frame 13 on the underside thereof. The support frame 13 extends in a direction generally perpendicular to the conductors 11.

The electrodes 10 are typically 0.109-inch diameter wires made of plow steel, and are electrically at the same potential as the support frame 13. Each electrode wire 10 has a sufficiently small radius of curvature to cause a corona discharge in the surrounding gas when a high-voltage direct current, (typically, a negative voltage in the 20- to 50-kilovolt range) is applied to the support frame 13. During operation of the precipitator, high-voltage direct current is applied to the support frame 13 by conventional means not shown in the drawing.

A particular one of the horizontal conductors 11, with its array of suspended high-voltage electrodes 10, is typically positioned in the precipitator between a corresponding particular pair of adjacent parallel collector phase electrodes (not shown). Thus, a plurality of passageways or lanes can be provided within the precipitator, each passageway being defined by the parallel collector plates positioned on either side thereof. A row of high-voltage electrodes 10 is suspended in each passageway, typically in the mid-plane between adjacent collector plates; and the collector plates are maintained at ground potential.

As a particulate-laden gas stream (e.g., flue gas from a coal-fired boiler) is passed through the passageways between the parallel collector plates in the precipitator, the strong electric field near each of the high-voltage electrodes 10 causes ionization of the gas, which results in electric charge being imparted to the particulates in the gas stream. Coulomb forces on the charged particulates due to the electric field between the collector plates and the high-voltage electrodes 10 drive the charged particulates toward either the collector plates or the high-voltage electrodes 10 depending upon the sign of the charge (i.e., negative or positive) on the particulates. With a negative voltage applied to the high-voltage electrodes 10, as is the usual arrangement in an industrial electrostatic precipitator, negatively charged particulates are drawn to the collector plates for deposition thereon, and any positively charged particulates present are attracted to the high-voltage electrodes 10. Electrophoretic forces due to non-uniformities in the electric field also act on the particulates, regardless of whether the particulates are charged or neutral, and are also responsible for deposition of particulates on the high-voltage electrodes.

Periodically, the support frame 13 is subjected to mechanical impact or "rapping" forces in order to dislodge accumulated particulates from the high-voltage electrodes 10 as well as from the conductors 11, the support rods 12 and the support frame 13. A heavy weighted device 15, called an impact rapper, is positioned above the support frame 13 for vertical movement up and down. Hammer-like blows, or impact forces, can be imparted to the support frame 13 by raising the rapper 15 to a height above the support frame 13 and then letting the rapper 15 fall onto the support frame 13 by gravity.

Each collector plate, or a support structure to which the collector plate is attached, is also rapped periodically to remove collected particulates therefrom. Since the collector plates are maintained at ground potential, there is no need for the collector plates (or for the rappers associated with the collector plates) to be electrically isolated from the various metallic components of the precipitator other than from the high-voltage components. However, the impact rapper 15, which comes into direct contact with the support frame 13 and thereby acquires the high-voltage electrical potential thereof, must be electrically isolated from the other metallic components of the precipitator in order to prevent grounding of the high-voltage electrodes 10. The particulates dislodged from the collector plates and from the high-voltage components (principally the wire electrodes 10) by the rapping procedure fall by gravity into a hopper at the bottom of the precipitator, where the particulates are collected for eventual removal from the precipitator.

The impact rapper 15 is of elongate configuration, preferably cylindrical, and has an upwardly extending rod portion 16 that serves as an armature for a solenoid 17. At least the rod portion 16 of the impact rapper 15 is made of a metal of high magnetic permeability (e.g., steel) in order to function as a solenoid armature. Preferably, the impact rapper 15 is an integral structure made entirely of steel. The armature rod 16 of the impact rapper 15 travels vertically up and down within a central bore 18 of an electrical insulator 19, as the impact rapper 15 is raised and lowered above the support frame 13. The insulator 19 isolates the impact rapper 15 from metallic structural components of the precipitator other than the support frame 13 and the high-voltage components connected to the support frame 13.

The insulator 19, which is of generally cylindrical configuration, extends through an opening in a roof portion of the precipitator housing. A flange plate 20 having a generally circular central aperture 21 is bolted through bolt holes 22 to the roof portion of the precipitator housing around the periphery of the opening. Motion of the impact rapper 15 upward to a fully withdrawn or "up" position away from the support frame 13 is effected by energizing the solenoid 17; and motion of the rapper 15 downward to an impact or "down" position in contact with the support frame 13 is effected by gravity when the solenoid 17 is de-energized. The height to which the impact rapper 15 is raised can be varied by varying the energy supplied to the solenoid 17.

The solenoid 17 is of generally hollow cylindrical configuration, and is mounted outside the precipitator housing and is aligned generally coaxially with respect to the bore 18 of the insulator 19. A generally cylindrical enclosure 23, which is supported on the flange plate 20, covers the solenoid 17 and that portion of the insulator 19 extending out of the precipitator through the aperture 21 in the flange plate 20.

A groove 24 is provided around the exterior wall of the insulator 19 where the insulator 19 passes through the aperture 21 in the flange plate 20. An annular support ring 25 having an external diameter larger than the diameter of the aperture 21 in the flange plate 20 is fitted tightly around the insulator 19 in the groove 24; and a gasket 26 is interposed in the groove 24 between the support ring 25 and the insulator 19. The support ring 25 is preferably made of cast steel, and the gasket 26 is preferably made of high temperature asbestos.

The insulator 19, with the surrounding support ring 25 in place in the groove 24, is positioned in the precipitator by being lowered through the aperture 21 until the flange plate 20 obstructs further downward movement of the support ring 25. Preferably, an annular gasket 27 made of high-temperature asbestos is interposed between the support ring 25 and the flange plate 20. Substantially the full weight of the insulator 19 is supported by the reaction force of the flange plate 20 against the support ring 25 through the gasket 27. The insulator 19, in addition to its electrical function, also cooperates with the flange plate 20, the annular support ring 25, and the gaskets 26 and 27 to provide a gas-tight seal at the opening in the roof portion of the precipitator housing through which the armature rod 16 of the impact rapper 15 is drawn up into the interior of the enclosure 23.

In order to prevent lateral movement of the support ring 25 on the flange plate 20, a vertically extending metallic cylindrical structure 28 is affixed (as by welding) to the flange plate 20 coaxially with respect to the support ring 25. The inner cylindrical wall of the cylindrical structure 28 abuts the outer edge of the support ring 25 to provide rigid positioning of the support ring 25. An outwardly extending horizontal flange 29 is affixed (as by welding) to the upper end of the cylindrical structure 28; and the solenoid 17 is secured (as by stud bolts 30) to the horizontal flange 29 concentrically around the insulator 19. The enclosure 23 covering the solenoid 17 and the top end of the insulator 19 is secured (as by machine screws 31) to the horizontal flange 29. A conventional electrical fitting 32 is secured to the horizontal flange 29 for coupling electrical power to the solenoid 17.

The electrical insulator 19 and the impact rapper 15 conduct heat from the interior of the precipitator upward into the enclosure 23. In order to protect the coils of the solenoid 17 from over-heating, a sleeve 33 of thermal insulation is provided around the portion of the electrical insulator 19 within the enclosure 23. The thermally insulating sleeve 33 may consist of mineral wool. In addition, it is advantageous to wrap a 1-inch thick layer of pipe insulation around the portion of the electrical insulator 19 within the enclosure 23.

The bottom end of the thermally insulating sleeve 33 rests on and is supported by the support ring 25. The top end of the sleeve 33 extends upward to a position in contact with a cap structure 34, which is fitted over and secured to a vertically extending cylindrical wall 35 of the enclosure 23. A rigid cylindrical guide member 36, preferably made of steel, is attached to the cap structure 34 (as by welding), and extends downward over the top end of the electrical insulator 19 to assure vertical alignment of the bore 18 of the insulator 19. An electrical insulator 37 of disc-like configuration is positioned over the top end of the insulator 19 underneath the cap structure 34 in order to isolate the impact rapper 15 from the cap structure 34 when the solenoid 17 is energized, i.e., when the rapper 15 is fully withdrawn to the "up" position.

In order to ventilate the interior of the enclosure 23, apertures 38 are provided in the horizontal flange 29 under the solenoid 17, and apertures 39 are provided in the cylindrical wall 35 of the enclosure 23 near the upper end thereof. A skirt portion 40 of the cap structure 34 covers the upper end of the cylindrical wall 35, but flares downwardly away from the apertures 39 in order to permit heated air to leave the interior of the enclosure 23.

In order to prevent the armature rod 16 from wearing against the insulator 19 as the impact rapper 15 moves up and down, a guide structure 41 is secured (as by a layer of low-expansion cement 42) to the bottom end of the insulator 19 within the precipitator housing. The guide structure 41 comprises a hollow cylindrical member 43 and a centrally apertured end wall 44, which covers the bottom end of the cylindrical member 43. The diameter of the central aperture of the end wall 44 is smaller than the diameter of the bore 18 of the insulator 19, so that the armature rod 16 is centered in the bore 18. In this way the armature rod 16 is prevented from rubbing against the insulator 19.

The particular embodiment of this invention described above is not to be construed in limitation of the invention, but rather is to be understood as the best mode presently contemplated by the inventors for carrying out their invention. The scope of the invention is not limited to particular details of the disclosed embodiment, but rather is defined by the following claims and their equivalents.

What is claimed is:

1. An impact rapper for vibrating an electrode support frame of an electrostatic precipitator, said support frame being charged with a high voltage, said rapper comprising: an elongate tubular high-voltage insulator, a rapper housing, means vertically mounting the proximal end of said insulator at its outer surface in said housing such that the distal end of said insulator extends downwardly a substantial distance below the bottom of said housing and is spaced above the electrode frame, an electrically conductive elongate rapper member having a cylindrical armature portion at one end thereof of a diameter that is smaller than the diameter of the bore of said insulator, said armature portion being freely vertically movable in the bore of said insulator, means attached to the extremity of said distal end of said insulator for guiding and spacing the rapper member along a vertical path of movement upwardly and downwardly within the bore of said insulator and being electrically isolated from said housing by said insulator, and solenoid means surrounding the proximal end of said insulator for cooperating with said armature portion of said rapper member and periodically causing said rapper member to be lifted upon energization thereof and dropped onto the electrode support frame thereafter upon de-energization thereof to thereby vibrate the electrode support frame, whereby when said rapper member is electrically charged by the electrode support frame, the insulator insulates the rapper housing from the rapper member to prevent grounding of the electrode support frame, and whereby when said rapper member is caused to move, said means for guiding and spacing prevents said rapper member from rubbing the inner surface of said insulator.

2. The impact rapper according to claim 1, wherein said rapper member is made of an integral construction including a cylindrical rapper portion adapted to strike the electrode support frame and an upwardly extending rod portion that terminates in said cylindrical armature portion which travels within said insulator.

3. The impact rapper according to claim 1 or 2, wherein the means attached to the distal end of said insulator for guiding and spacing the rapper member comprises a guide member cemented thereto having a cylindrical wall and a bottom wall, said bottom wall having a central aperture coaxial with the bore of said insulator for slidably receiving, guiding and spacing the rapper member in said insulator, said aperture having a diameter intermediate those of the cylindrical armature portion of said rapper member and the insulator bore.

4. The impact rapper according to claim 1, wherein said outer surface of said insulator comprises an annular groove therein, and wherein said means for vertically mounting the proximal end of said insulator comprises a coaxial annular support member engaging said insulator at said groove for substantially supporting the weight of said insulator.

* * * * *